United States Patent [19]

Anahara et al.

[11] 4,437,302

[45] Mar. 20, 1984

[54] FALSE TWISTING AIR NOZZLE

[75] Inventors: Meiji Anahara, Kariya; Hiroshi Omori, Aichi, both of Japan

[73] Assignee: Kabushiki Kaisha Toyoda Jidoshokki Seisakusho, Aichi, Japan

[21] Appl. No.: 459,131

[22] Filed: Jan. 19, 1983

[30] Foreign Application Priority Data

| | | | |
|---|---|---|---|
| Jan. 20, 1982 | [JP] | Japan | 57-7269 |
| Dec. 4, 1982 | [JP] | Japan | 57-183824[U] |
| Dec. 6, 1982 | [JP] | Japan | 57-184579[U] |
| Dec. 11, 1982 | [JP] | Japan | 57-217566 |

[51] Int. Cl.[3] ..... D01H 7/92; D02G 1/04

[52] U.S. Cl. ..... 57/333; 57/403

[58] Field of Search ..... 57/332, 333, 350, 403, 57/908

[56] References Cited

U.S. PATENT DOCUMENTS

| | | | |
|---|---|---|---|
| 3,340,684 | 9/1967 | Shichman | 57/333 X |
| 3,424,359 | 1/1969 | Houle et al. | 57/333 X |
| 3,490,219 | 1/1970 | Ozawa et al. | 57/333 X |
| 4,142,354 | 3/1979 | Nakahara | 57/333 X |
| 4,183,202 | 11/1980 | Morihashi | 57/333 X |

FOREIGN PATENT DOCUMENTS

| | | | |
|---|---|---|---|
| 52-63439 | 5/1977 | Japan | 57/333 |

*Primary Examiner*—Donald Watkins

*Attorney, Agent, or Firm*—Brooks, Haidt, Haffner & Delahunty

[57] ABSTRACT

A false twisting air nozzle for use in fasciated yarn spinning and the like. The air nozzle has a fiber bundle passage for allowing a fiber bundle to pass therethrough in a direction, the fiber bundle passage including an inlet, a smaller-diameter hole portion, and a larger-diameter hole portion which are arranged in series. An air injection hole has end opening tangentially and downstream in the larger-diameter hole portion. Air passages are disposed around the smaller-diameter hole portion and held in communication with the larger-diameter hole portion for increasing the force with which the fiber bundle can be drawn into the air nozzle. The air passages may be a plurality of slots defined in an inner wall surface of the smaller-diameter hole portion or a plurality of independent holes defined radially outwardly of the smaller-diameter hole portion.

21 Claims, 27 Drawing Figures

FALSE TWISTING AIR NOZZLE

BACKGROUND OF THE INVENTION

1. Field of the Invention

The present invention relates to a false twisting air nozzle employed for fasciated yarn spinning, and more particularly to such an air nozzle having a fiber bundle passage including an inlet, a smaller-diameter hole portion, and a larger-diameter hole portion arranged in the order named from an upstream end to a downstream end thereof in the direction of travel of a bundle of fibers, there being at least one air injection port opening tangentially in the downstream direction in the larger-diameter hole portion of the fiber bundle passage.

2. Description of the Prior Art

Ring spinning has been employed for many years to produce spun yarns composed of short fibers. Due to the low production rate, however, the ring spinning is being replaced with new spinning methods capable of producing spun yarns at higher rates of production. Such new spinning methods include open-end spinning, self-twist spinning etc. These spinning methods still have disadvantages. For example, the open-end spinning process fails to achieve spinning operation at much higher speeds as the process requires a heavy rotor to be rotated, and has a problem in spinning thin yarns of the yarn count 40 and over. Although the self-twist spinning can produce spun yarns at high speeds, it is subjected to a limitation on the length of fibers it can handle, and is restricted to spinning of two folded yarns.

To solve the shortcomings with the foregoing spinning processes, there has been proposed fasciated yarn spinning which is based on the principle of high-speed yarn twisting effected by false twisting. According to the fasciated yarn spinning, a flat ribbon of fibers that has been supplied from a drafting device is twisted and untwisted by a false twisting nozzle to produce a fasciated spun yarn. The fasciated yarn spinning method utilizes, as a main component, an air false twisting nozzle which is required, as shown in FIG. 1 of the accompanying drawings, both to draw a bundle of fibers fed out by front rollers F into the nozzle and to turn the fiber bundle to twist and untwist the same. The former function serves the purpose of introducing the fiber bundle into the nozzle, and the latter function serves the purpose of binding together the fiber bundle. The former function is also important in preventing the fibers from being wound on the front rollers F and waste cotton from being produced.

As illustrated in FIG. 1, the conventional false twisting nozzle comprises an inlet 1 progressively spreading toward a fiber bundle supply end (to the left as shown), a smaller-diameter hole portion 2 and a larger-diameter hole portion 3 which are contiguous to the inlet 1. Air injection holes 4 have ends opening in the larger-diameter hole portion tangentially in a downstream direction (to the right as shown). Another prior nozzle comprises, a shown in FIG. 2, a fiber bundle passage having a smaller-diameter hole portion 2 and a larger-diameter hole portion 3 interconnected by a connecting portion 5 in which an end of an air injection hole 4 opens.

The force with which the fiber bundle is drawn into the nozzle can be produced by a stream of air injected from the air injection hole 4 into the nozzle, and is affected by various factors such for example as the diameters of the hole portions 2 and 3, the angle at which the latter spreads downstream, and the angle of inclination of the air injection hole 4. In particular, the fiber sucking force is greatly influenced by the smaller-diameter hole portion 2 in that the smaller the diameter of the hole portion 2, the smaller the fiber sucking force becomes. It is therefore effective in increasing the fiber sucking force to enlarge the diameter of the smaller-diameter hole portion 2. With the increased diameter of the hole portion 2, however, the fiber bundle as it is rotated by the air stream undergoes accelerated ballooning and hence is not fed along stably, with the results that the resultant yarn will have varied yarn strengths or be caused to break off in extreme cases. The diameter of the smaller-diameter hole portion 2 of the conventional nozzle is reduced to a size small enough to suppress such yarn ballooning. This prevents the fiber suction force from being sufficiently great, resulting in troubles such as the production of fly or waste cotton due to an air stream caused by high-speed rotation of the fiber bundle supply unit and the winding of fibers onto the fibers bundle supply unit.

SUMMARY OF THE INVENTION

It is an object of the present invention to provide a false twisting air nozzle for drawing in a fiber bundle with an increased force without accelerating ballooning of the fiber bundle and for preventing fly or waste cotton from being produced and fibers from being wound onto a fiber bundle supply unit when the latter rotates at a higher speed.

Another object of the present invention is to provide a false twisting air nozzle for enabling a fiber bundle to escape smoothly out of any one of a plurality of slots defined in an inner wall surface of a fiber bundle passage even if the fiber bundle is being trapped in the slot, thereby minimizing the danger of yarn breakage during spinning of thin yarns.

Still another object of the present invention is to provide a false twisting air nozzle having a bent fiber bundle passage for preventing a fiber bundle from ballooning to allow the fiber bundle to run stably and promote the generation of free fibers.

A still further object of the present invention is to provide a false twisting air nozzle composed of two members which can be fabricated with ease and a high degree of precision.

According to the present invention, a false twisting air nozzle comprises a fiber bundle passage for allowing a fiber bundle to pass therethrough in one direction, the fiber bundle passage including an inlet, a smaller-diameter hole portion, and a larger-diameter hole portion which are arranged in the order named in said direction, at least one air injection hole having end opening tangentially and downstream in the larger-diameter hole portion, and at least one air passage disposed around and adjacent to the smaller-diameter hole portion and held in communication with the larger-diameter portion.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 3:
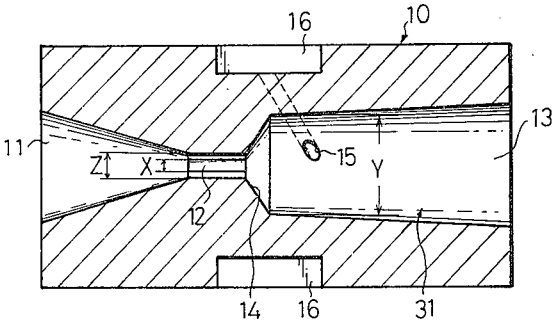
FIG. 3 is a longitudinal cross-sectional view of a false twisting air nozzle according to a first embodiment of the present invention.

A false twisting air nozzle according to a first embodiment of the present invention will be described with reference to FIGS. 3 through 7. A fiber bundle in the form of a wide ribbon is drafted by and supplied continuously from a fiber bundle supply unit (not shown), and is twisted and untwisted by a false twisting nozzle 10 so as to be formed into a fasciated yarn. The false twisting nozzle 10 is positioned behind or downstream of final or front rollers of the group of draft rollers which constitute the fiber bundle supply unit. As shown in FIG. 3, the nozzle 10 has an axial fiber bundle passage 31 composed of a fiber bundle inlet 11, a smaller-diameter hole portion 12, a larger-diameter hole portion 13, and a connecting portion 14 which interconnects the smaller- and larger-diameter hole portions 12, 13, the inlet 11 and the portions 12–14 being coaxilly aligned with each other. The fiber bundle inlet 11 has its diameter progressively larger from the end of the smaller-diameter hole portion 12 toward the front rollers (to the left in FIG. 3) to allow the wide fiber bundle to be smoothly guided into the smaller-diameter hole portion 12. The larger-diameter hole portion 13 has its diameter progressively larger from the connecting portion 14 to an outlet end of the hole portion 13 (to the right in FIG. 3).

A pair of air injection holes 15 have respective ends opening into the larger-diameter hole portion 13 in diametrically opposite or symmetrical relation at wall portions near an upstream end of the hole portion 13 which is disposed near the smaller-diameter hole portion 12. The air injection holes 15 extend tangentially to the larger-diameter hole portion 13 and in the downstream direction. While as many such air injection holes as desired may be provided, two of them, preferably three to five, should be provided to create a well-distributed vortex of air in the fiber bundle passage 31. The air injection holes 15 may be opened at the connecting portion 14. The air injection holes 15 have other ends connected to air tanks 16 disposed around the false twisting nozzle 10 and connected to an external source (not shown) of compressed air. The larger-diameter hole portion 13 may not be of a continuously and smoothly changing diameter as shown, but of diameters that vary stepwise in the axial direction.

Figure 5:
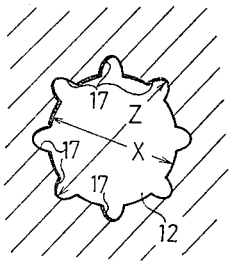
FIG. 5 is an enlarged transverse cross-sectional view of a smaller-diameter hole portion in the air nozzle shown in FIGS. 3 and 4.

The smaller-diameter hole portion 12 is of a circular cross section and has a diameter large enough to allow passage therethrough of the fiber bundle and small enough to minimize ballooning occasioned by rotation of the fiber bundle. The diameter of the smaller-diameter hole portion 12 should preferably be in the range of from about 1 to 3 mm dependent on the thickness of the fiber bundle. As illustrated in FIG. 5, the inner peripheral wall surface of the smaller-diameter hole portion 12 has a plurality of slots 17 extending axially thereof in diametrically opposite or symmetrical pairs and each having a round cross section. The slots 17 serve as passages for air drawn in through the fiber bundle inlet 11.

The false twisting nozzle 10 thus constructed operates as follows: Air is injected into the larger-diameter hole portion 13 through the air injection holes 15 opening near the upstream end of the hole portion 13, and travels downstream as a helical air flow along the inner wall surface of the larger-diameter hole portion 13. This helical air flow induces another stream of air which flows from the fiber bundle inlet 11 through the smaller-diameter hole portion 12 into the larger-diameter hole portion 13. The air stream as it is induced at an increased flow rate generates a large amount of force to draw the fiber bundle in the inlet 11. The flow rate of the air stream which is drawn in through the inlet 11 is affected by factors such as the dimensions of the larger-diameter hole portion 13, the diameter of the air injection holes 15, the angle formed between the axes of the air injection holes 15 and the axis of the larger-diameter hole portion 13, the number of the air injection holes 15, and the pressure of air supplied. The flow rate, however, is most influenced by the cross-sectional area of the opening of the smaller-diameter hole portion 12.

With the false twisting nozzle 10, the fiber bundle that has been supplied from the fiber bundle supply unit rotates in the inlet 11 and the smaller-diameter hole portion 12 while travelling forward meanderingly. The movement of the fiber bundle is limited by the circular wall surface of the smaller-diameter hole portion 12 so as not to enter the slots 17 defined in the wall surface of the hole portion 12. The cross-sectional area of the smaller-diameter hole portion 12 in which the fiber bundle passes is limited to a circular area having a diameter X suitable for permitting the fiber bundle to pass therethrough and preventing ballooning due to rotation of the fiber bundle. Since the overall cross-sectional area of the smaller-diameter hole portion 12 is the combination of the circular area having the diameter X and the cross-sectional areas of the slots 17, air is drawn in through the inlet 11 at an increased rate notwithstanding the diameter of the smaller-diameter hole portion 12 is relatively small for the prevention of ballooning. Therefore, the force with which the false twisting nozzle 10 draws the fiber bundle is increased and hence the fiber bundle as it is supplied from the front rollers is introduced into the smaller-diameter hole portion 12 more effectively. This eliminates production of fly or waste cotton, prevents fibers from being wound onto the front rollers, and allows fibers on opposite sides of the fiber bundle nipped by the front rollers into a wide ribbon to serve effectively as fasciated yarn, so that the resulting spun yarn will have an increased yarn strength.

The slots 17 defined in the inner peripheral wall surface of the smaller-diameter hole portion 12 act to keep the fiber bundle from rotating while the fiber bundle passes through the smaller-diameter hole portion 12. The number of false twists imparted to the fiber bundle by the vortex of air stream in the larger-diameter hole portion 13 is therefore reduced and it accelerates the production of fasciated yarn and suppresses the free motion of fibers on the periphery of the fiber bundle, increasing the fasciating effect when the false twists are removed in the larger-diameter hole portion 13.

Figure 1:
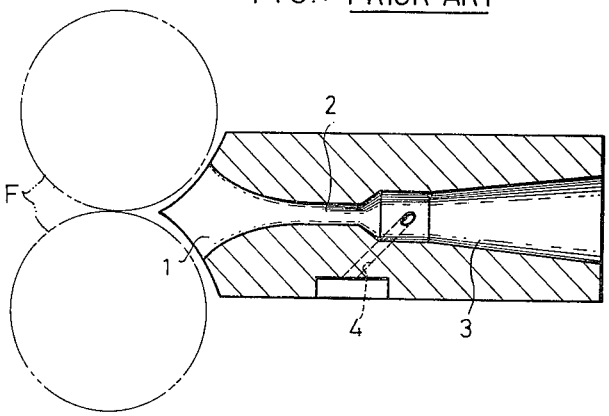
FIG.1 PRIOR ART
FIGS. 1 and 2 are longitudinal cross-sectional view of conventional false twisting air nozzles, respectively.
Figure 4:
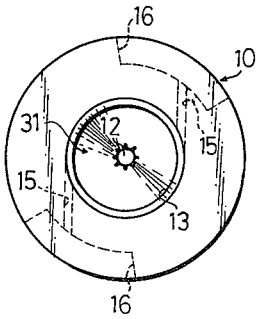
FIG. 4 is a side elevational view of the false twisting air nozzle shown in FIG. 3.
Figure 2:
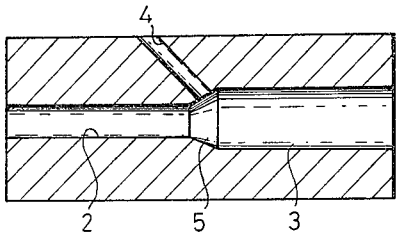
FIG.2 PRIOR ART
Figure 6:
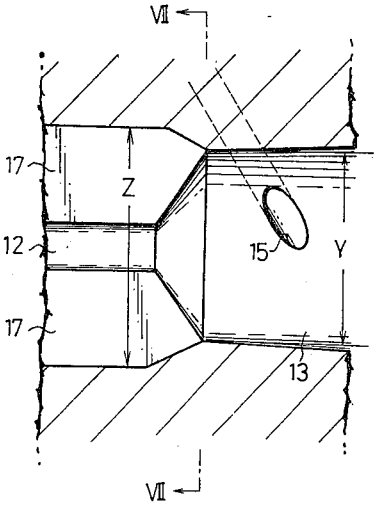
FIG. 6 is an enlarged fragmentary longitudinal cross-sectional view of a modified arrangement for the air nozzle of the first embodiment.
Figure 7:
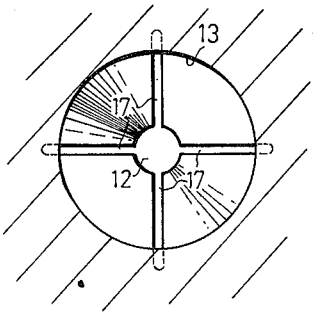
FIG. 7 is a cross-sectional view taken along line VII—VII of FIG. 6.

The distance Z between the bottoms of diametrically opposite slots 17 need not be smaller than the diameter Y of the larger-diameter hole portion 13 at its upstream end. However, the distance Z may be larger than the diameter Y provided the slots are smoothly joined to the larger-diameter hole portion 13, as shown in FIGS. 6 and 7.

Figure 8:
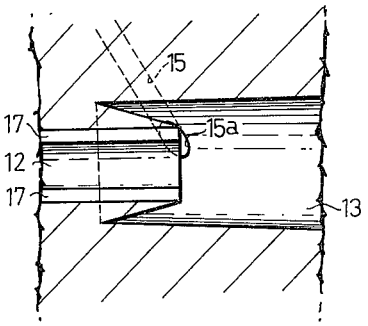
FIG. 8 is an enlarged fragmentary longitudinal cross-sectional view of a false twisting air nozzle according to a second embodiment of the present invention.

A false twisting air nozzle according to a second embodiment will be described with reference to FIG. 8. The nozzle shown in FIG. 8 differs from the nozzle of the first embodiment in that a smaller-diameter hole portion 12 has a downstream end projecting into a larger-diameter hole portion 13 and located in the vicinity of an opening 15*a* of an air injection hole 15 defined in an inner wall surface of the larger-diameter hole portion 13. Slots 17 are defined in an inner wall surface of the smaller-diameter hole portion 12. The false twisting air nozzle according to the second embodiment operates and is advantageous in substantially the same manner as the false twisting air nozzle of the first embodiment. Additionally, the nozzle of FIG. 8 allows peripheral fibers on the fiber bundle, when it is introduced from the smaller-diameter hole portion 12 into the larger-diameter hole portion 13, to be firmly wound around the fiber bundle due to a rotational impact they receive from an air stream injected from the air injection nozzles 15. Therefore, the fibers can be fasciated together more effectively, and the resultant spun yarn will have an increased yarn strength.

Figure 10:
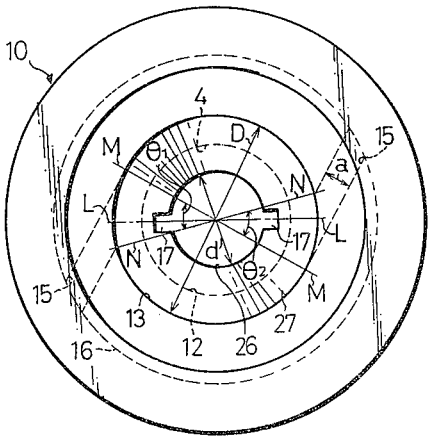
FIG. 10 is an enlarged right side view of FIG. 9.
Figure 9:
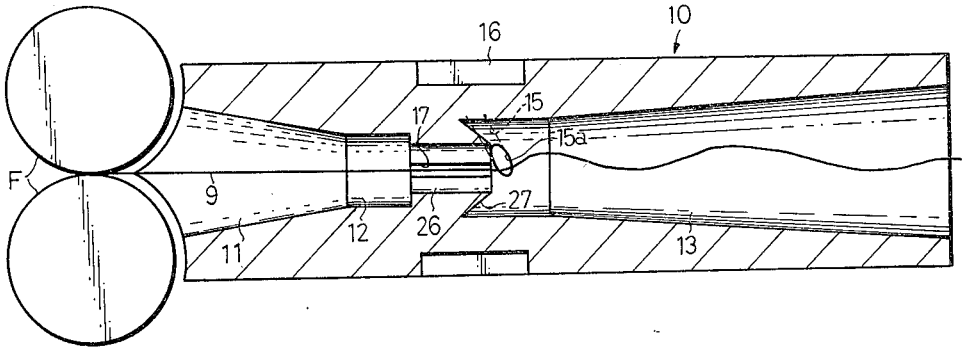
FIG. 9 is a longitudinal cross-sectional view of a false twisting air nozzle according to a third embodiment of the present invention.
Figure 11:
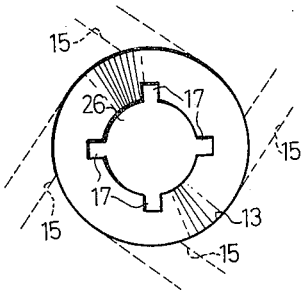
FIG. 11 is an enlarged fragmentary side elevational view of a modification with four slots for the air nozzle of the third embodiment.

FIGS. 9 and 10 illustrate a false twisting air nozzle according to a third embodiment. A smaller-diameter hole portion 12 is followed at its downstream end by a minimum-diameter hole portion 26 smaller in diameter than the smaller-diameter hole portion 12. The minimum-diameter hole portion 26 has a downstream end projecting into a larger-diameter hole portion 13 to a position near an opening 15*a* of each air injection hole 15, the projecting end of the hole portion 26 being joined to an upstream end of the larger-diameter hole portion 13 by a conically tapered wall surface 27. Where the minimum-diameter hole portion 26 has an inside diameter d, the upstream end of the larger-diameter hole portion 13 has an inside diameter D, and the air injection hole 15 has a diameter a, is it preferable that the following relationship be met: $d \leqq D-2a$. The minimum-diameter hole portion 26 has in its inner wall surface as many slots 17 of a rectangular cross section as there are air injection holes 15. The slots 17 have one end opening into the larger-diameter hole portion 13 and the other end opening into the smaller-diameter hole portion 12. In the arrangement of FIG. 10, there are two slots 17 and two air injection holes 15. In a modified arrangement shown in FIG. 11, there are four slots 17 and four air injection holes 15.

As illustrated in FIG. 10, which is seen from a downstream end of the false twisting air nozzle 10, a straight line L passing through transverse centers of the slots 17 and an axis of the smaller-diameter hole portion 12 lies in acute angles $\theta_1$, $\theta_2$ formed between straight lines M, N passing through the ends of major axes of ellipses defined by the openings 15*a* of the air injection holes 15 in the larger-diameter hole portion 13 and an axis of the latter.

With the false twisting air nozzle 10 of the third embodiment, the fiber bundle which is designated by the reference numeral 9 is movable transversely only in a circular area defined by the minimum-diameter hole portion 26 so that ballooning can be prevented from occurring and the yarn can run stably. The slots 17 in the minimum-diameter hole portion 26 serve to prevent the fiber bundle 9 from rotating which is twisted by the vortex action of the injected air. This reduces upstream propagation of false twists imparted to the fiber bundle 9 by the vortex of air stream, and hence accelerates production of free fibers that remain unwound around the twisted fiber bundle 9 at the inlet 11. The fibers will then be fasciated firmly together when the false twists are removed in the larger-diameter hole portion 13, and the resulting yarn strength will be much higher. The slots 17 increase the amount of air introduced from the inlet 11 to thereby reduce fly or waste cotton produced in the vicinity of the inlet 11.

Where spun yarns to be produced are thinner, there is a chance for the fiber bundle 9 as it passes through the minimum-diameter hole portion 26 to get trapped in the slots 17. Although such a danger depends on the size of the slots 17, the fiber bundle 9 generally has a diameter on the order of 0.3 mm and the machinable width of the slots is about 0.3 mm, with the result that the fiber bundle 9 is likely to enter the slots 17. When the fiber bundle 9 is trapped in one of the slots 17, the fiber bundle 9 is prevented from rotating, and no twist will be imparted upstream to the front roller F. The produced yarn will have localized portions in which fibers are not fasciated sufficiently strongly, and will sometimes be broken.

With the false twisting air nozzle 10 as shown in FIG. 10, the slots 17 are provided as many as the air injection holes 15, and the straight line L passing through the transverse centers of the slots 17 and the axis of the smaller-diameter hole portion 12 lies in the acute angles $\theta_1$, $\theta_2$ formed between the straight lines M, N passing through the ends of major axes of ellipses defined by the openings 15*a* of the air injection holes 15 in the larger-diameter hole portion 13 and the axis of the latter, as seen from the downstream end of the nozzle 10. The air stream as injected from the air injection holes 15 acts on the fiber bundle 9 in a direction to separate from the slots 17, thereby preventing the fiber bundle 9 from entering the slots 17. Even when the fiber bundle 9 is trapped in one of the slots 17, the fiber bundle 9 can immediately be freed therefrom by the action of the air stream coming from the air injection holes 15. If the straight line L were angularly displaced counterclockwise out of the acute angles $\theta_1$, $\theta_2$, the injected air would fail to push out the fiber bundle 9 in the event of the latter's being trapped in one of the slots 17. If the straight line L were angularly displaced clockwise out of the acute angles, the injected air would act on the fiber bundle 9 in a direction to push the same deeply into the slot 17.

Since the downstream end of the minimum-diameter hole portion 26 projects in the vicinity of the opening 15*a* of each of the air injection holes 15, peripheral fibers will be wound firmly around the fiber bundle 9 upon impact by the air flow injected from the air injection holes 15 simultaneously with the entry of the fiber bundle 9 from the minimum-diameter hole portion 26 into the larger-diameter hole portion 13, an arrangement which is the same as that of the second embodiment. Accordingly, the resultant spun yarn has fibers fasciated together very firmly and is of an increased yarn strength. With the relationship $d \leqq D-2a$ being met, the air flow from the inlet 11 can be introduced through the minimum-diameter hole portion 26 into the larger-diameter hole portion 13 without being disturbed by the air stream injected from the air injection holes 15, with the consequence that an increased amount of air can flow into the nozzle to reduce fly or waste cotton produced in the vicinity of the front rollers F and contribute to an increase in the yarn strength.

Figure 12:
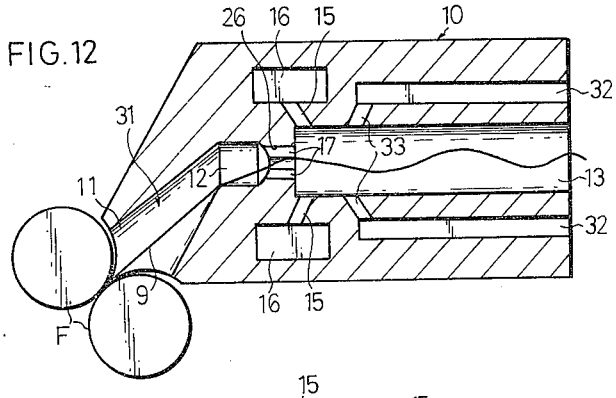
FIG. 12 is a longitudinal cross-sectional view of a false twisting air nozzle according to a fourth embodiment of the present invention.

A false twisting air nozzle according to a fourth embodiment will be described with reference to FIG. 12. The false twisting air nozzle 10 of the fourth embodiment differs from the nozzle according to the third embodiment in that a fiber bundle passage 31 is bent where the inlet 11 and the smaller-diameter hole portion 12 are joined, air discharge holes 32 are provided around a larger-diameter hole portion 13 downstream of air injection holes 15 and have one ends opening at the downstream end of the nozzle 10, and the air discharge holes 32 are held in communication with the larger-diameter hole portion 13 by means of air discharge passages 33, respectively. In operation, a fiber bundle 9 is brought into contact with a wall surface of the smaller-diameter hole portion 12 where the fiber bundle passage 31 is bent, to thereby suppress ballooning, allow the yarn to run stably, and accelerate free fiber generation. The air discharge holes 32 permit air injected into the larger-diameter hole portion 13 to be discharged also through the air discharge holes 32. This arrangement allows accelerated air discharge which increases the rate of air flow introduced with the fiber bundle 9 from the inlet 11, thus decreasing the amount of fly or waste cotton produced and improving the yarn strength.

Figure 13:
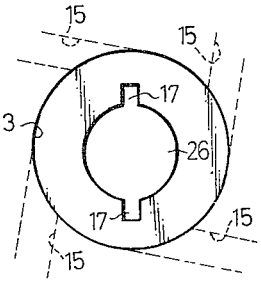
FIG. 13 is an enlarged fragmentary side elevational view of a modified structure having slots fewer than air injection holes for the air nozzles of the third and fourth embodiments.

As shown in FIG. 13, the slots 17 may be fewer than the air injection holes 15. Furthermore, each slot 17 may be of a trapezoidal or semielliptical cross section, or the fiber bundle passage 31 may be bent at a position other than the interconnection between the inlet 11 and the smaller-diameter hole portion 12.

Figure 14:
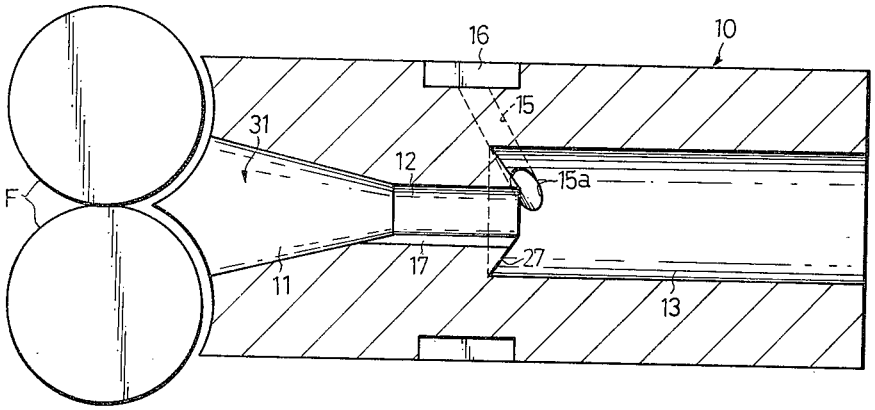
FIG. 14 is a longitudinal cross-sectional view of a false twisting air nozzle according to a fifth embodiment of the present invention.
Figure 15:
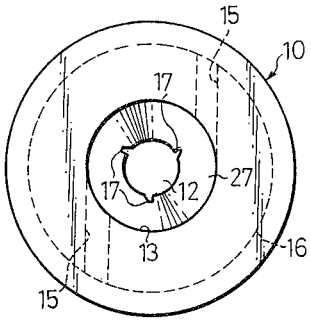
FIG. 15 is a side elevational view of the air nozzle illustrative in FIG. 14.
Figure 16:
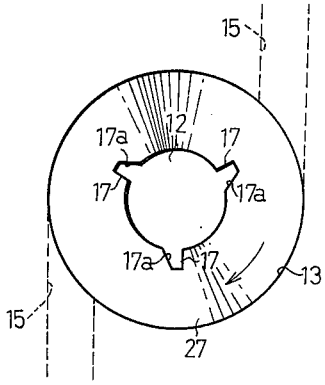
FIG. 16 is an enlarged fragmentary side elevational view of a plurality of slots in the air nozzle of FIG. 15.

FIGS. 14 through 16 illustrate a false twisting air nozzle in accordance with a fifth embodiment. Slots 17 are defined in an inner wall surface of a smaller-diameter hole portion 12 and communicate with an inlet 11 and a larger-diameter hole portion 13. As shown in FIG. 16, each slot 17 has a side wall surface 17*a* inclined such that the width of the slot 17 diverges progressively toward its open end, the side wall surface 17*a* being located downstream of an opposite side wall surface in the direction of the arrow in which a vortex of air rotates in the larger-diameter hole portion 13.

When the fiber bundle is trapped in one of the slots 17, the fiber bundle can escape immediately from the slot 17 along the side wall surface 17*a* without being resisted thereby.

Figure 17:
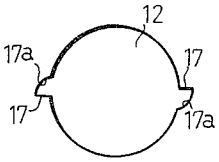
FIG. 17 is an enlarged fragmentary side elevational view of a modification with differently shaped slots for the air nozzle of the fifth embodiment.

As illustrated in FIG. 17, the side wall surface 17*a* of each slot 17 may be curved. Alternatively, each slot 17 may be of a V-shaped cross section.

Figure 18:
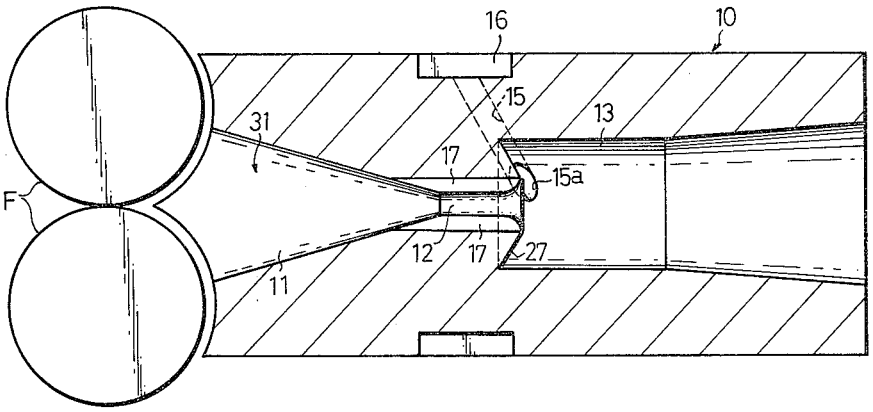
FIG. 18 is a longitudinal cross-sectional view of a false twisting air nozzle according to a sixth embodiment of the present invention.
Figure 19:
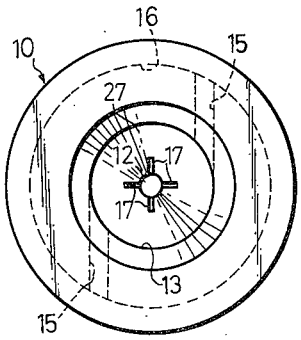
FIG. 19 is a side elevational view of the air nozzle illustrated in FIG. 18.
Figure 20:
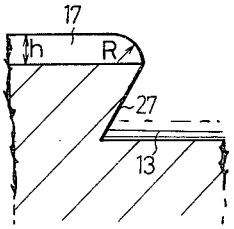
FIG. 20 is an enlarged fragmentary cross-sectional view of a projecting end of a smaller-diameter hole portion of the air nozzle shown in FIG. 18.

A false twisting air nozzle in accordance with a sixth embodiment will be described with reference to FIGS. 18 through 20. A smaller-diameter hole portion 12 has a downstream end projecting into a larger-diameter hole portion 13 and joined to an upstream end of the larger-diameter hole portion 13 by a conically tapered wall surface 27. The smaller-diameter hole portion 12 has in its inner wall surface slots 17 communicating with an inlet 11 and the larger-diameter hole portion 13 and extending parallel to an axis of the smaller-diameter hole portion 12. The projecting end of the smaller-diameter hole portion 12 has an arcuate inner wall edge rounded with a radius of curvature R which is larger than a depth h of each slot 17. Each air injection hole 15 partially opens in the larger-diameter hole portion 13 upstream of the projecting end of the smaller-diameter hole portion 12.

Figure 21:
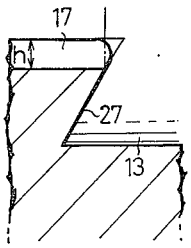
FIGS. 21 and 22 are enlarged fragmentary cross-sectional views of projecting ends of smaller-diameter hole portions for comparison with the projecting end shown in FIG. 20.
Figure 22:
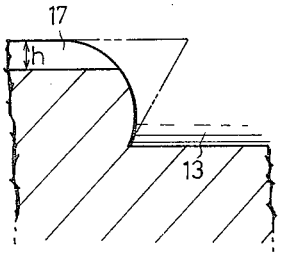

The downstream end of the smaller-diameter hole portion 12 is where the introduced fiber bundle starts ballooning violently due to air streams injected from the air injection holes 15, and hence the fiber bundle is held in utmost frictional contact with the downstream end of the smaller-diameter hole portion 12. If this downstream end were too sharp, it would cut off the fiber bundle held thereagainst strongly. With the arrangement as shown in FIG. 20, the arcuate inner wall edge of the projecting end of the smaller-diameter hole portion 12 has the radius of curvature R greater than the depth h of the slots 17, and the slots 17 have end wall surfaces disposed upstream of the downstream end of the joining wall surface 27, with the result that the fiber bundle will not be caught in the slots 17 when ballooning violently.

Where the radius of curvature R were smaller than the depth h of the slots 17, the end wall surfaces of the slots 17 would be disposed downstream of the downstream end of the joining wall surface 27 as shown in FIG. 21, resulting in a greater tendency for the ballooning fiber bundle to get caught by the projecting end of the smaller-diameter hole portion 12. If the radius of curvature R were larger than twice the depth h of the slots 17, on the other hand, the downstream end of the smaller-diameter hole portion 12 projecting into the larger-diameter hole portion 13 would be distorted largely in shape as illustrated in FIG. 22, causing disturbances in the injected air streams which would be detremental to an increase in the yarn strength. For the reasons described above, the radius of curvature R should preferably be smaller than twice the depth h of the slots 17.

Figure 23:
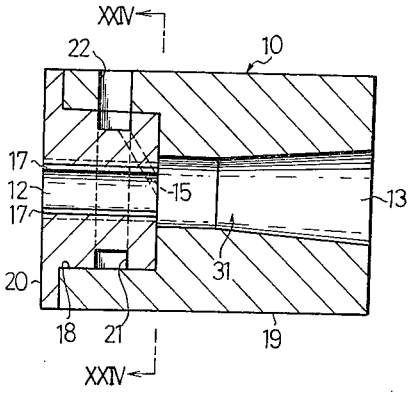
FIG. 23 is a longitudinal cross-sectional view of a false twisting air nozzle according to a seventh embodiment of the present invention.
Figure 24:
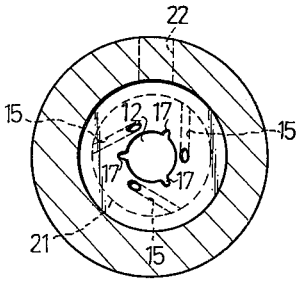
FIG. 24 is a cross-sectional view taken along line XXIV—XXIV of FIG. 23.

In FIGS. 23 and 24 which show a false twisting air nozzle according to a seventh embodiment, the false twisting air nozzle 10 does not comprise an integral body as do the air nozzles according to the first through sixth embodiments, but is composed of a block 19 having therein a larger-diameter hole portion 13 and a recess 18, and an insert 20 serving as a wall forming member and having therein a smaller-diameter hole portion 12 and air injection holes 15, the insert 20 being fitted in the recess 18 in the block 19. The insert 20 has in its outer periphery an annular groove 21 in which ends of the air injection holes 15 are opened and which serves as an annular air tank when the insert 20 is fitted in the block 19. The block 19 has an attachment recess 22 communicating with the annular groove 21 for receiving a connecting tube extending from the external source of compressed air. The smaller-diameter hole portion 12 has in its inner wall surface three slots 17 extending out of communication with the air injection holes 15.

The false twisting air nozzle according to this embodiment operates and is advantageous in the same manner as the false twisting air nozzle according to the first embodiment. In addition, the nozzle 10 as a whole can be fabricated more easily since the insert 20 with the air injection holes 15 is formed independently of the block 19 with the larger-diameter hole portion 13. The smaller-diameter hole portion 12 and the air injection holes 15 which require a high degree of precision can be fabricated nicely. Since the air injection holes 15 can be formed from their air outlet sides, there are no burrs left around the air injection holes 15 in the fiber bundle passage 31 after the holes 15 have been drilled.

Figure 25:
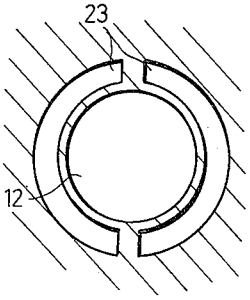
FIGS. 25 and 26 are transverse cross-sectional views of false twisting air nozzles having independent holes serving as air flow passages.
Figure 26:
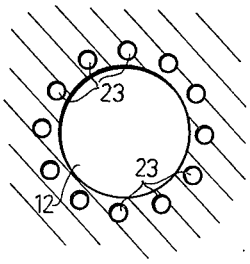
Figure 27:
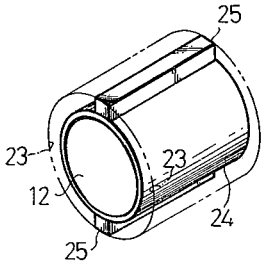
FIG. 27 is a perspective view of a modified false twisting air nozzle having independent holes defined by a pair of ridges mounted on and projecting radially outwardly from a pipe.

Instead of the slots 17 communicating with the smaller-diameter hole portion 12, a plurality of independent holes 23 may be defined as air passages around the smaller-diameter hole portion 12 out of communication therewith, as shown in FIGS. 25 and 26, or the slots 17 and the independent holes 23 may extend helically along the smaller-diameter hole portion 12, not parallel to the axis thereof. Where the independent holes 23 are provided, it is preferred that they be shaped smoothly not to catch fly or waste cotton where they are joined to the fiber bundle inlet 11, and the independent holes 23 be positioned closely to the smaller-diameter hole portion 12.

The inner wall of the smaller-diameter hole portion 12 may be fabricated separately from a body of the false twisting air nozzle 10, so that the inner wall can be fitted later in the air nozzle body. With such an arrangement, the independent holes 23 can be defined simply by fitting in the nozzle body a member including a pipe 24 having therein a smaller-diameter hole portion 12 and a pair of ridges 25 projecting radially outwardly and extending from end to end on the pipe 24. The slots 17, either straight or helical, and the independent holes 23 can thus be defined with ease. The body which has the smaller-diameter hole portion 12 therein may be made of wear-resistant material so that the false twisting nozzle will have an extended service life.

In all of the foregoing embodiments, the slots and holes defined around the smaller-diameter hole portion 12 for passage of an introduced air flow may be provided as many as desired and in desired positions. The fiber bundle may be supplied by aprons or a combination of an apron and a roller, instead of nip rollers.

Although certain preferred embodiments have been shown and described, it should be understood that many changes and modifications may be made therein without departing from the scope of the appended claims.

What is claimed is:

1. A false twisting air nozzle comprising:

a fiber bundle passage for allowing a fiber bundle to pass therethrough, said fiber bundle passage including an inlet, a smaller-diameter hole portion, and a larger-diameter hole portion which are arranged in series;

at least one air injection hole having end opening tangentially and downstream in said larger-diameter hole portion; and at least one air passage disposed adjacent to said smaller-diameter hole portion and in communication with said larger-diameter portion.

2. A false twisting air nozzle according to claim 1, wherein said air passage comprises at least one slot defined in an inner wall surface of said smaller-diameter hole portion and substantially extending parallel to an axis of said smaller-diameter hole portion.

3. A false twisting air nozzle according to claim 2, wherein said slot is of a rectangular cross-section.

4. A false twisting air nozzle according to claim 2, wherein said slot is of a round cross-section.

5. A false twisting air nozzle according to claim 2, where each said slot is one of a pair thereof disposed in such a manner that a straight line passing through the transverse centers of each said pair of slots and an axis of said smaller-diameter hole portion lines, as seen from a downstream end of the air nozzle, within the respective acute angle formed by straight lines passing though the ends of major axes of ellipses defined by the ends of said air injection holes in said larger-diameter hole portion and an axis of the latter.

6. A false twisting air nozzle according to claim 5, wherein said smaller-diameter hole portion is followed by a minimum-diameter hole portion smaller in diameter than said smaller-diameter hole portion, said slots being disposed in said minimum-diameter hole portion.

7. A false twisting air nozzle according to claim 1, wherein said fiber bundle passage has a bent portion between said inlet and said smaller-diameter hole portion for permitting the fiber bundle to contact an inner wall surface of said smaller-diameter hole portion in said bent portion.

8. A false twisting air nozzle according to claim 2, wherein said slot extends fully longitudinally along said smaller-diameter hole portion and has a side wall surface inclined such that the width of the slot progressively increases toward its open side, said side wall surface being located downstream of an opposite side surface thereof with respect to the direction of rotation of a vortex of air produced in said larger-diameter hole portion.

9. A false twisting air nozzle according to claim 8, wherein said side wall surface is flat.

10. A false twisting air nozzle according to claim 8, wherein said side wall surface is curved.

11. A false twisting air nozzle according to claim 2, wherein said smaller-diameter hole portion has a downstream end projecting into said larger-diameter hole portion in the vicinity of said ends of said air injection holes, whereby the fiber bundle after having passed through said smaller-diameter hole portion will be rotated upon impact by an air stream injected from said air injection holes when the fiber bundle enters said larger-diameter hole portion.

12. A false twisting air nozzle according to claim 11, wherein said slot extends fully longitudinally along said smaller-diameter hole portion, said projecting downstream end of said smaller-diameter hole portion being joined to an upstream end of said larger-diameter hole portion by a joining tapered wall surface, said projecting downstream end having an arcuate inner edge having a radius of curvature larger than the depth of said slot, with said slot having an end wall surface positioned downstream of a downstream end of said joining tapered wall surface.

13. A false twisting air nozzle according to claim 11, wherein each of said air injection holes is partially opened upstream of said projecting downstream end of said smaller-diameter hole portion.

14. A false twisting air nozzle according to claim 1, wherein said air passage comprises at least one independent hole separated from said smaller-diameter hole portion by an inner wall surface thereof and having one end communicating with said inlet and an opposite end with said larger-diameter hole portion.

15. A false twisting air nozzle according to claim 14, wherein each said independent hole is one of a pair of holes disposed radially outwardly of said smaller-diameter hole portion, each said independent hole being substantially semiarcuate in cross section in surrounding relation to said smaller-diameter hole portion.

16. A false twisting air nozzle according to claim 14, wherein each said independent hole is one of a plurality thereof disposed radially outwardly of said smaller-diameter hole portion, each said independent hole being circular in cross section, said independent holes being arranged in an annular array in surrounding relation to said smaller-diameter hole portion.

17. A false twisting air nozzle according to claim 14, including a member comprising a pipe in which said smaller-diameter hole portion is defined and a pair of ridges mounted on an outer periphery of said pipe and extending axially from end to end of said pipe, and a nozzle body having said larger-diameter hole portion and said air injection holes, said independent hole being defined between said pipe and said nozzle body when said member is fitted in said nozzle body.

18. A false twisting air nozzle according to claim 1, including a block member and a wall forming member fitted in said block member, said smaller-diameter hole portion being defined by said wall forming member, and said larger-diameter hole portion being defined by said block member.

19. A false twisting air nozzle according to claim 18, wherein said air injection holes are defined also by said wall forming member, said wall forming member being concentrically fitted in said block member.

20. A false twisting air nozzle according to claim 1, which further comprises at least one air discharge passage extending from the interior of said larger-diameter hole portion and substantially adjacent thereto, to the downstream end of said nozzle.

21. A false twisting ar nozzle according to claim 1, wherein the diameter of said smaller-diameter hole portion is not greater than the diameter of said larger-diameter hole portion minus substantially twice the diameter of said one air injection hole.

* * * * *